US010801157B2

(12) United States Patent
Bombardieri

(10) Patent No.: US 10,801,157 B2
(45) Date of Patent: Oct. 13, 2020

(54) WASHING/DRYING MACHINE WITH A DEVICE FOR CLEANING AN AIR FILTER

(71) Applicant: WHIRLPOOL EMEA S.P.A., Pero (IT)

(72) Inventor: Giovanni Bombardieri, Albino (IT)

(73) Assignee: Whirlpool EMEA S.p.A., Pero (IT)

( * ) Notice: Subject to any disclaimer, the term of this patent is extended or adjusted under 35 U.S.C. 154(b) by 282 days.

(21) Appl. No.: 15/540,881

(22) PCT Filed: Dec. 2, 2015

(86) PCT No.: PCT/IB2015/059283
§ 371 (c)(1),
(2) Date: Jun. 29, 2017

(87) PCT Pub. No.: WO2016/108101
PCT Pub. Date: Jul. 7, 2016

(65) Prior Publication Data
US 2017/0350063 A1 Dec. 7, 2017

(30) Foreign Application Priority Data
Dec. 30, 2014 (IT) ..... TO2014A1121

(51) Int. Cl.
*D06F 58/22* (2006.01)
*D06F 58/24* (2006.01)
*D06F 58/10* (2006.01)
*D06F 25/00* (2006.01)
*D06F 58/30* (2020.01)
(Continued)

(52) U.S. Cl.
CPC ..... *D06F 58/10* (2013.01); *B08B 3/02* (2013.01); *B08B 3/04* (2013.01); *D06F 25/00* (2013.01); *D06F 39/10* (2013.01); *D06F 58/22* (2013.01); *D06F 58/24* (2013.01); *D06F 58/30* (2020.02); *D06F 39/083* (2013.01)

(58) Field of Classification Search
CPC ..... D06F 58/22; D06F 58/24; D06F 25/00
See application file for complete search history.

(56) References Cited

U.S. PATENT DOCUMENTS 3,292,347 A * 12/1966 Hodgkinson ..... D06F 58/22 261/83
3,959,891 A * 6/1976 Burkall ..... D06F 58/22 34/82

(Continued)

FOREIGN PATENT DOCUMENTS

EP 0816549 A2 1/1998
EP 1647621 A1 4/2006

(Continued)

OTHER PUBLICATIONS

JP2009142351—Machine Translation (Year: 2009).*
International Search Report and Written Opinion of the International Searching Authority dated Mar. 7, 2016.

*Primary Examiner* — Marc Lorenzi
(74) *Attorney, Agent, or Firm* — McGarry Bair PC

(57) ABSTRACT

The invention relates to a washing/drying machine equipped with a filter cleaning device for removing filaments released by laundry items during the washing/drying cycle. For this purpose, the cleaning device comprises nozzles that spray water onto the filtering walls, on the side thereof facing towards the drying tub.

7 Claims, 6 Drawing Sheets

(51) Int. Cl.

| | |
|---|---|
| ***D06F 39/10*** | (2006.01) |
| ***B08B 3/02*** | (2006.01) |
| ***B08B 3/04*** | (2006.01) |
| *D06F 39/08* | (2006.01) |

(56) References Cited

U.S. PATENT DOCUMENTS

| | | | | |
|---|---|---|---|---|
| 4,316,726 | A * | 2/1982 | Hopper | D06F 58/24 68/18 C |
| 2006/0123854 | A1* | 6/2006 | Hong | D06F 25/00 68/19.1 |
| 2010/0146812 | A1* | 6/2010 | Ahn | D06F 58/22 34/480 |
| 2012/0090189 | A1* | 4/2012 | Kwon | D06F 25/00 34/82 |
| 2013/0212894 | A1* | 8/2013 | Kim | F26B 21/003 34/82 |
| 2013/0263630 | A1* | 10/2013 | Doh | D06F 25/00 68/20 |

FOREIGN PATENT DOCUMENTS

| | | | | |
|---|---|---|---|---|
| EP | 1907616 | A1 | 4/2008 | |
| EP | 2116647 | A1 | 11/2009 | |
| EP | 2202349 | A2 | 6/2010 | |
| EP | 1775368 | B1 | 2/2011 | |
| EP | 2281081 | B1 | 12/2011 | |
| EP | 2669417 | A1 | 12/2013 | |
| JP | 2009142351 | A * | 7/2009 | |
| WO | 2007000645 | A1 | 1/2007 | |
| WO | 2014102322 | A1 | 7/2014 | |
| WO | WO-2015101892 | A1 * | 7/2015 | D06F 25/00 |

* cited by examiner

WASHING/DRYING MACHINE WITH A DEVICE FOR CLEANING AN AIR FILTER

CROSS-REFERENCE TO RELATED APPLICATIONS

This application claims priority from International Application No. PCT/IB2015/059283, filed Dec. 2, 2015, which claims priority from Italian Application No. TO2014A001121, filed Dec. 30, 2014, both of which are incorporated herein by reference in their entirety.

BACKGROUND

The present invention relates to a washing/drying machine, i.e. machines for household, industrial or commercial use intended for washing and drying laundry in general.

These machines, therefore, have some elements in common with washing machines, e.g. the washing tub or chamber that houses a rotary basket or drum; the clothing or, more generally, the laundry to be treated is loaded into the basket through a door, which may be located either at the front or at the top, depending on the machine type.

The rotation of the basket keeps the load moving during the washing and/or drying phases, when the tub is supplied with water and air, respectively.

In the course of the working cycle of the washing/drying machine, the load, consisting of clothing, such as trousers, T-shirts and underwear, or cloths and the like, normally releases filaments that are evacuated through the drain.

This occurs in a simple and direct manner during the wash, in that water is supplied and drained several times for washing the laundry with detergents, rinsing it, etc., so that the filaments released by the fabrics are removed from the laundry and evacuated together with the water being drained.

BRIEF DESCRIPTION

One embodiment of the disclosure is a washing/drying machine that has a washing/drying chamber, a basket housed in the chamber for loading laundry to be treated, a circuit for circulating air taken in from the chamber and then reintroduced therein, and a filter for filtering the air along the circulation circuit. The filter has a cleaning device adapted to spray water onto the filter, on the side thereof whereon filaments get deposited during the circulation of air in the associated circuit.

Another embodiment of the disclosure is a washing/drying machine that has a tub, a basket housed in the tub, a circulation circuit circulating air taken in from the tub, and a filter assembly. The filter assembly has a substantially cylindrical geometry and supports at least one filtering wall for filtering the air along the circulation circuit. The filter also has a filter cleaning device that has water nozzles arranged peripherally in a crown-like pattern relative to the cylindrical geometry that can spray water onto the at least one filtering wall.

DRAWINGS

Such features will become more apparent from the following description of a preferred but non-limiting example of embodiment thereof as shown in the annexed drawings, wherein.

DESCRIPTION

Figure 1:
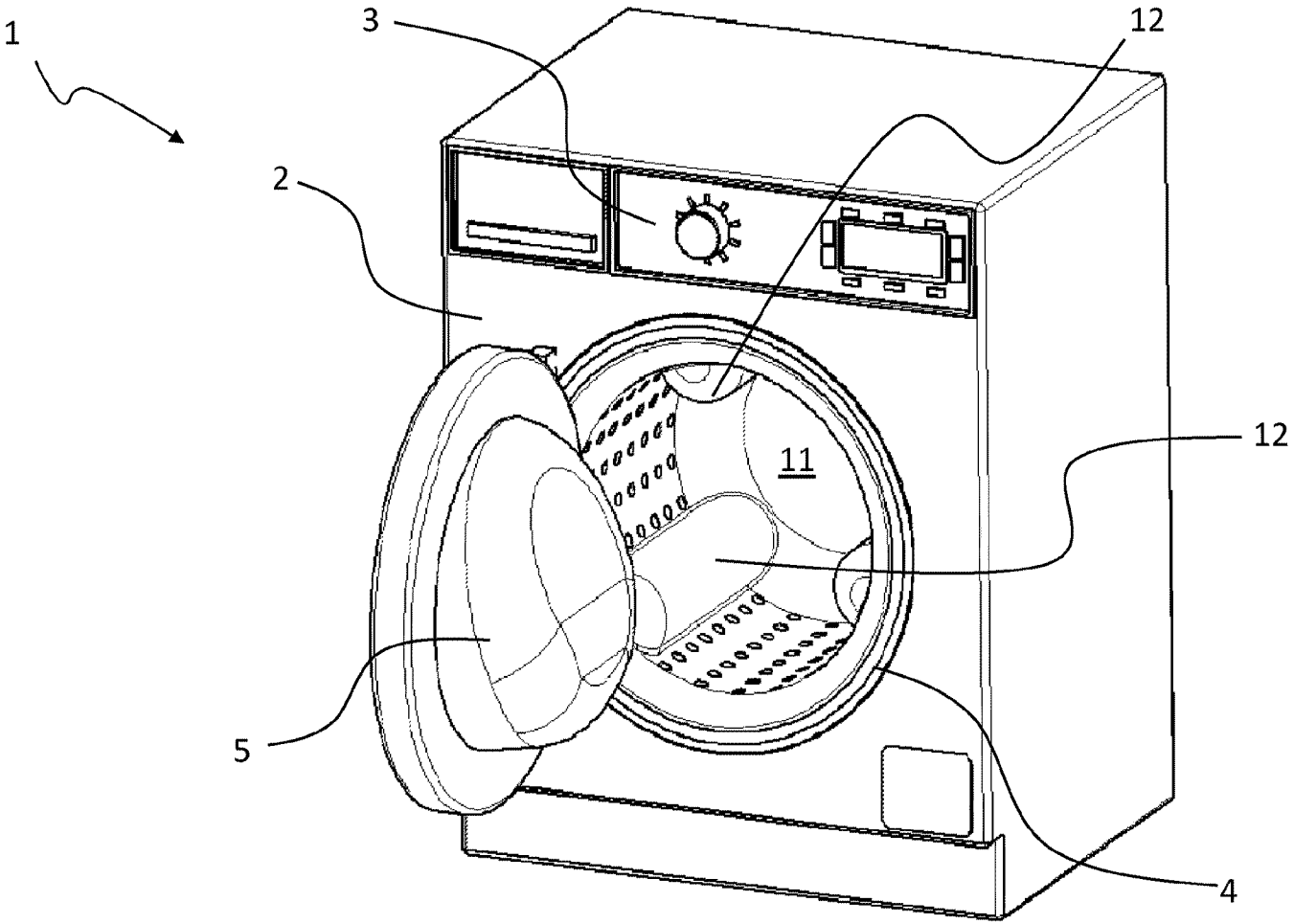
FIG. 1 is a perspective view of a washing/drying machine according to the invention.
Figure 2:
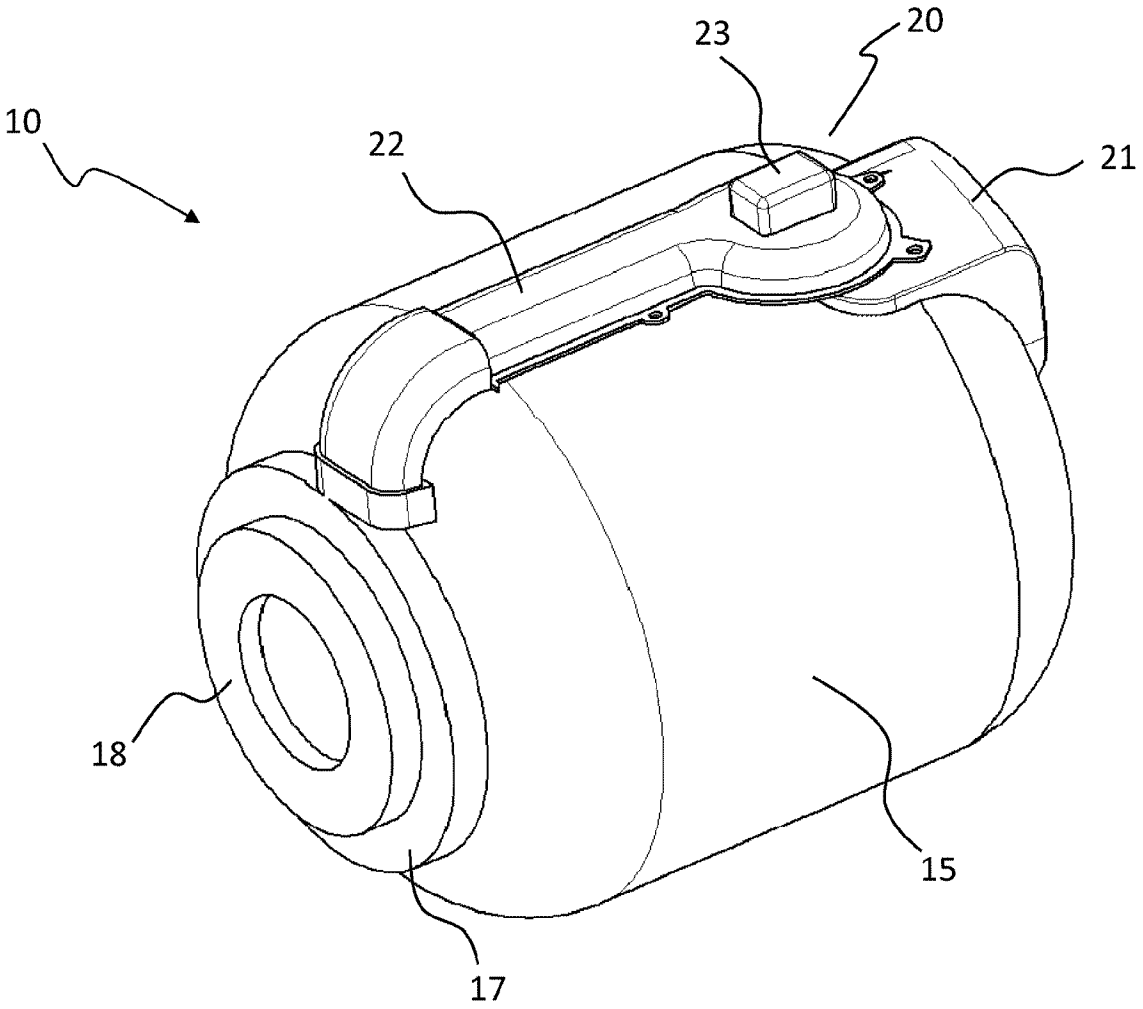
FIG. 2 is a perspective view of the washing/drying tub or chamber of the machine of FIG. 1, with the associated drying circuit.
Figure 3:
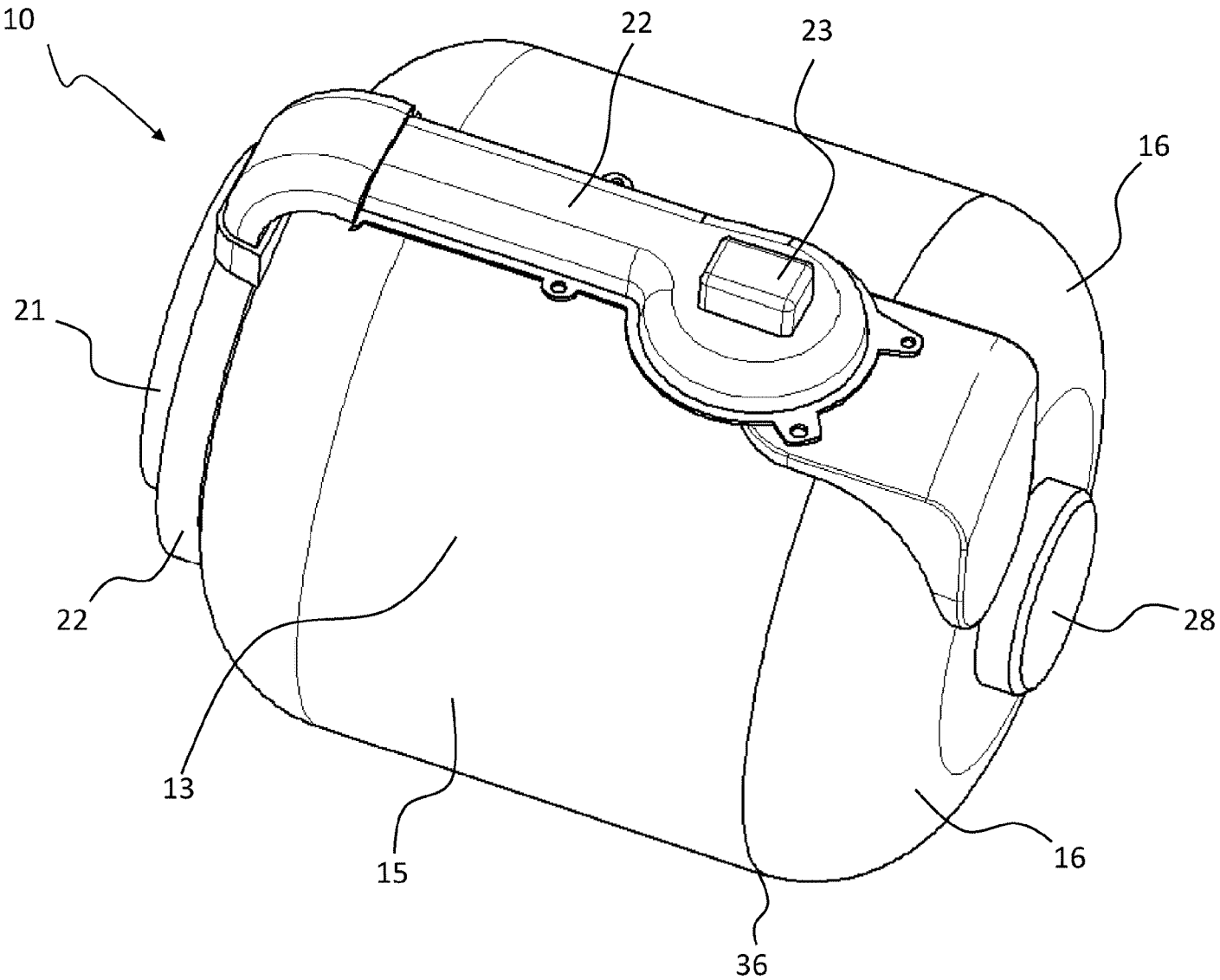
FIG. 3 is a perspective view of the washing/drying tub of the machine of FIG. 1 from a different angle than FIG. 2.

After the wash process, when laundry is being dried, the filamentous wads generated by the clothes rubbing against the inner wall of the basket (the quantity of which increases as humidity decreases) are dragged by the air flow that circulates in the machine and laps the laundry items contained in the basket for drying them, but cannot be evacuated in the same way because no water is supplied into the basket during the drying cycle.

As can be easily understood, the drying air must be cyclically filtered to prevent the fan and the associated electric heating resistor, included in the air circuit, from suffering damage.

To this end, it is known to take air from the washing/drying tub, filter it, reduce the humidity thereof, and introduce it again into the tub.

The air is filtered as it flows through a filter comprising a grid or net made of metal, plastic or the like, arranged on a wall of the washing/drying chamber (in particular, on the back wall, at the outlet section towards the drying circuit), the mesh of which is sufficiently tight to trap the filaments released by the fabrics; it can be easily understood that the filamentous wads progressively depositing onto the filter will reduce the air passage section thereof and will cause load losses that will slow down the air flow, resulting in a general reduction of the efficiency of the laundry drying cycle.

The present invention aims at overcoming this problem that limits the state of the art.

Therefore, the technical problem at the basis of the invention is to provide a washing/drying machine having such structural and operating characteristics that keep regular and efficient air filtering conditions, so as to ensure the execution of a correct laundry drying cycle.

The idea that solves this problem is to remove from the filter the filaments deposited thereon by the air during the laundry drying cycle: in this way, it is possible to prevent the filter from getting clogged quickly, thus keeping it efficient for a longer time and reducing the load losses and the resulting higher energy consumption of the washing/drying machine.

According to the invention, this is achieved by spraying water onto the filter, in particular on the side thereof where air-borne filaments, fibres, etc. get deposited.

In more detail, with reference to the above-listed drawings, reference numeral 1 designates as a whole a washing/drying machine in accordance with the present invention, which comprises an external structure 2 substantially shaped like a parallelepiped cabinet, with a front panel 3 equipped with user controls (e.g. push-buttons, knobs, etc.) and various indicators, lamps, user interface displays, and other means such as detergent drawers, useful for the operation of the machine 1.

It is worth pointing out that reference will be made in this description, for simplicity and clarity, only to those elements of the washing/drying machine 1 which are useful for understanding the invention, whereas the other details of the machine will be neglected in order to avoid discussing aspects of the machine not related to the purposes of the present description; for more information about these secondary aspects of the machine, reference can be made to the prior art, e.g. washing/drying machines created by the present Applicant or described in patent applications filed by the latter on this matter, such as European patent applications EP 2116647, EP 2281081, EP1907616, EP 1775368, EP 1647621 and more, which are integrally recalled herein, and the contents of which should be considered as incorporated in the present description because applicable thereto.

At the front of the cabinet 2 there is the load opening 4 of the washing/drying machine, which is closed by a door 5.

The cabinet 2 of the washing/drying machine internally houses a washing/drying chamber or tub 10, in which a basket 11 for loading laundry to be treated is supported in a per se known manner. The chamber or tub 10 is intended for washing/drying laundry, in that a machine like the one considered herein performs a dual function as a water tub during the washing cycle and as a drying chamber during the drying cycle.

Figure 4:
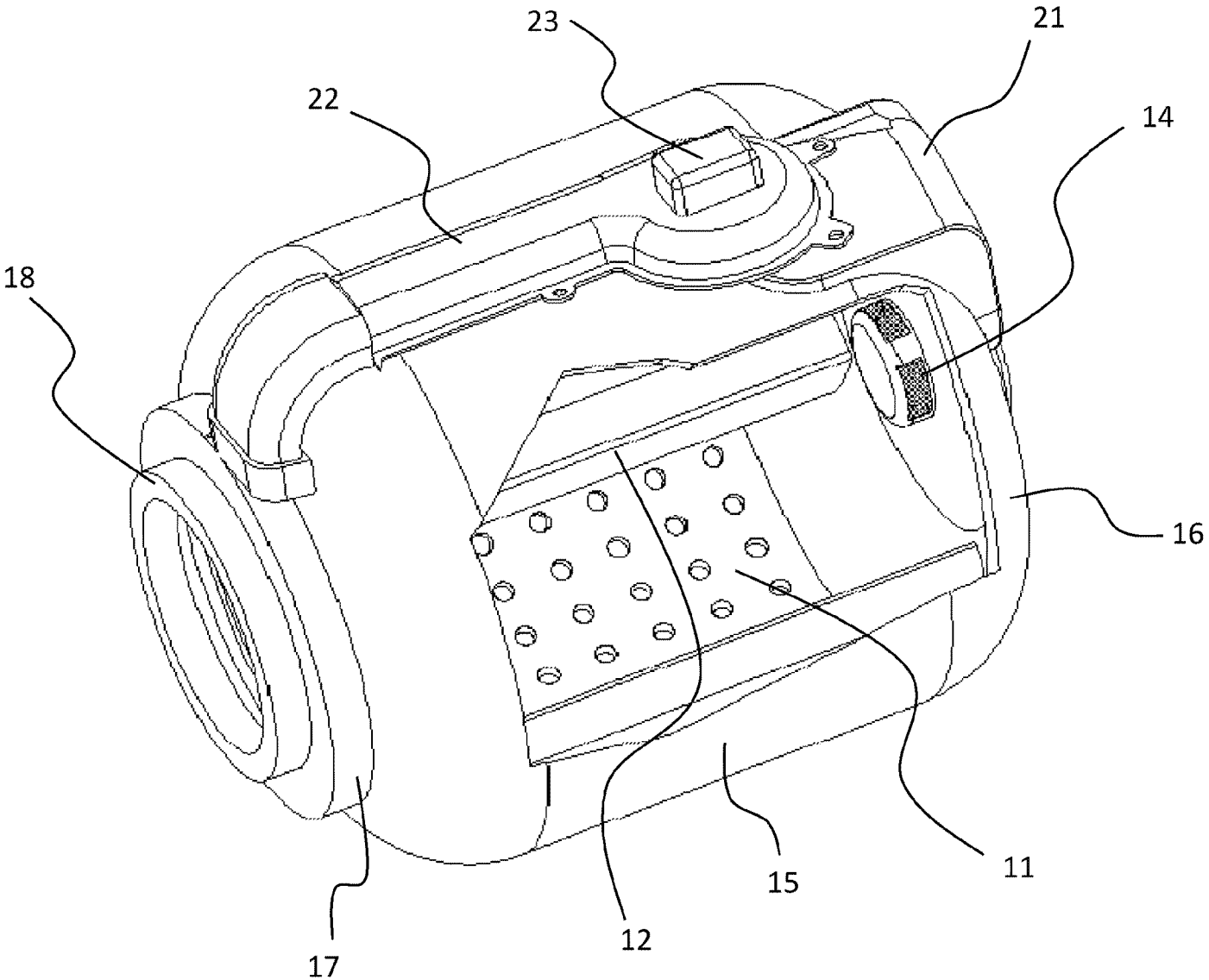
FIG. 4 shows the tub of FIGS. 2 and 3 with a part thereof removed to make the internal parts visible.

The basket 11 has the typical cylindrical drum-like configuration, with a perforated side wall allowing water to flow through, as visible in FIGS. 1 and 4, and is equipped with inner paddles or lifters 12 for stirring the load while rotating when the machine 1 is in operation.

The chamber 10 comprises a substantially cylindrical skirt or side wall 15 (possibly slightly convex), closed at the rear by a back wall 16, while at the front it has a collar 17 on which a gasket 18 is applied, sealing the opening 4 of the cabinet 2 of the washing/drying machine 1.

Outside the chamber 10 a drying air circuit 20 is arranged, which comprises an intake channel 21 (also acting as a condenser) and a delivery channel 22, between which a fan 23 is arranged for air circulation.

In particular, the delivery channel 22 extends from the collar 17 of the chamber 10 to the fan 23, whereas the intake channel 21 extends from the fan 23 to an intake port formed in the back wall 16 of the chamber 10, where there is a filter 25 for the filaments borne by the drying air. The filter 25 is slightly eccentric relative to the axis of rotation of the basket 11, where the support and/or rotation means of the basket 11, such as shaft, bearings, pulleys, etc. (not shown in the drawings because they are per se known) are applied to the back wall 16 of the chamber 10.

The filter 25 may be designed in any suitable manner, e.g. with a metal or plastic grid or net having a mesh suitable for trapping the filaments released by the laundry being treated in the washing/drying machine 1; the mesh may have a polygonal (e.g. square, rectangular, hexagonal) or circular shape, etc., the mesh size being smaller than 1 $mm^2$.

Figure 5:
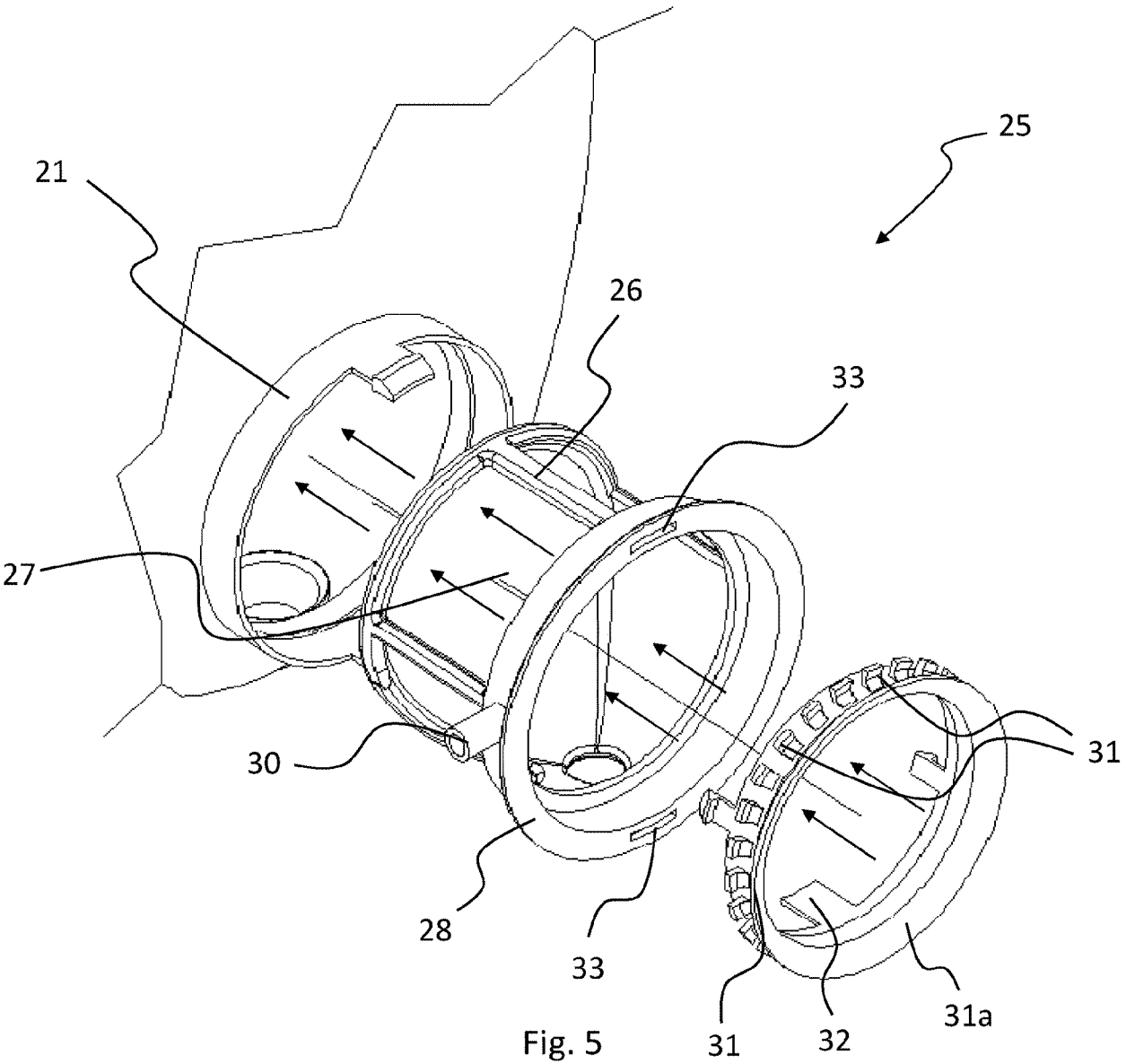
FIGS. 5 and 6 show a detail of the filter cleaning device of the washing/drying machine of the preceding figures.
Figure 6:
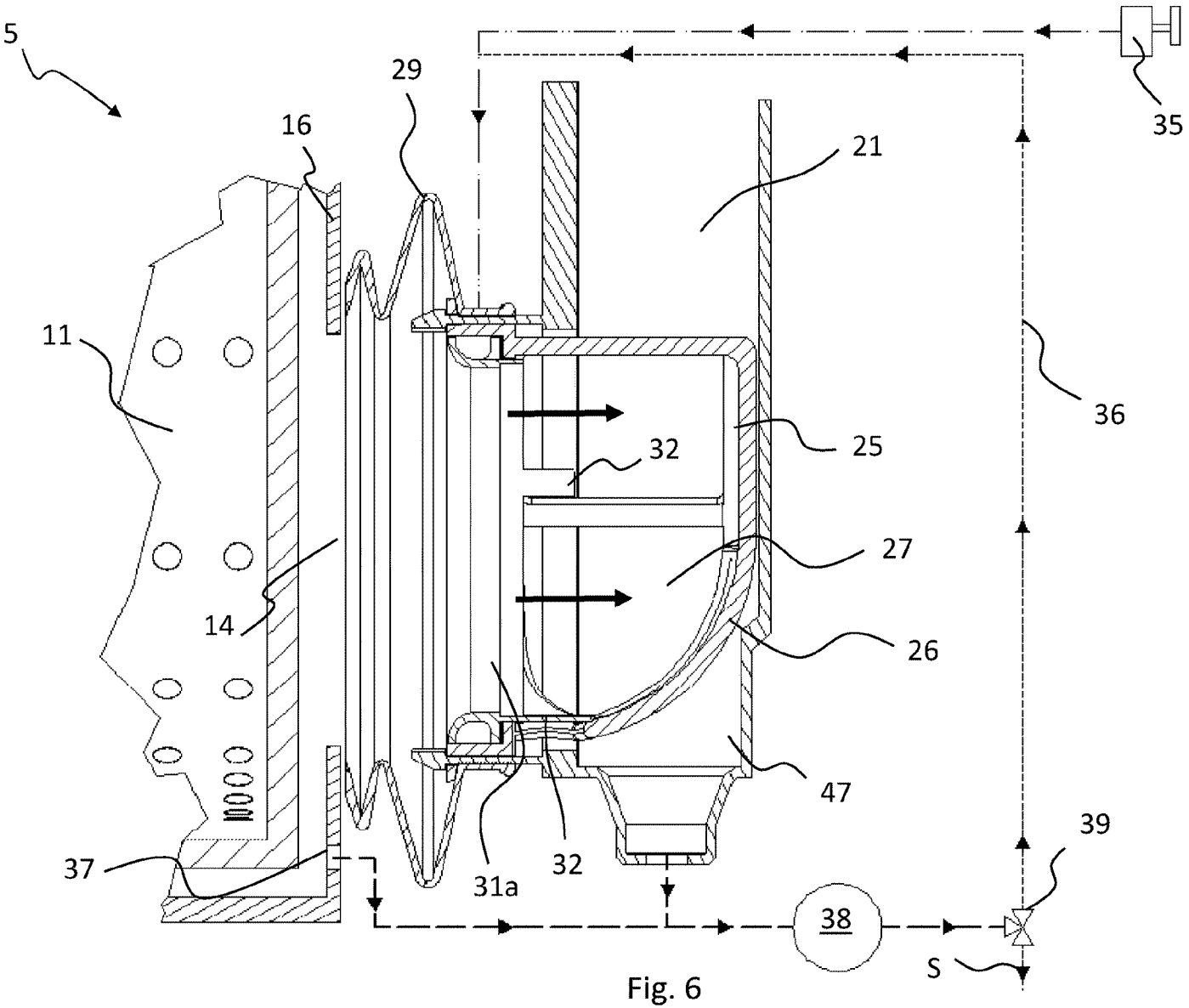

In the embodiment of FIGS. 5 and 6, the filter 25 is applied to the back wall 16 of the tub 10, at an aperture 14 in the wall 16, and extends into the intake duct 21.

The filter 25 comprise a cage-like structure 26, the side walls 27 of which consist of a filtering grid of the above-mentioned type; the structure 26 comprises a base or ring 28 for fitting it to the wall 16 of the tub 10, preferably associated with a bellows-type sealing gasket 29, which is provided with a fitting 30 for connection to a pipe (not shown for simplicity) for supplying water to a filter cleaning device 5.

In this example, the cleaning device 5 comprises a crown 31*a* of nozzles 31, which is advantageously associated with the base 28 of the structure 26 of the filter 25, thus being also useful for supporting it; various solutions are possible for associating the crown 31*a* of nozzles 31 with the filter structure 26: the drawings show a bayonet-type mounting, wherein a number of appendices 32 of the crown 31*a* engage into matching seats or slots 33 in the structure.

The crown of nozzles 31 is connected to a hydraulic circuit for water supply, which comprises a tap or intake electrovalve 35 fitted to or anyway associated with the water mains that supplies the washing/drying machine 1, and a branch 36 for recirculating the water extracted from the bottom of the washing/drying chamber 10 through a first drain 37.

The connection between the electrovalve 35 and the crown 31*a* of nozzles 31 may or may not include an air break, and the jets from the nozzles 31 must have sufficient pressure to effectively hit the filter 25 and its side walls 27.

The structure 26 with the crown 31*a* of nozzles 31 is at least partly housed in the intake and condensation channel 21, which is secured to the back wall 16 of the washing chamber 10; advantageously, in the lower part of the intake channel 21 there is a second drain 47 for the water sprayed by the nozzles 31 (as well as for the condensed water created by the condenser in the channel 21).

Thus, the water collected by gravity on the bottom of the channel 21 will be evacuated into the recirculation branch 36; in this regard, it must be pointed out that the vertical arrangement of the intake duct 21, resulting from its application to the back wall 16, will promote the evacuation by gravity from the drain 47 towards the recirculation branch 36.

To this end, in accordance with a preferred embodiment, the device 5 for cleaning the filter 25 allows the water, especially the condensed water generated during the laundry drying stage, to be recirculated into the branch 36 by a pump 38 that gives it sufficient pressure to clean the filter 25.

In this case, along the hydraulic circuit there is also a diverting valve 39, which can direct the flow either towards the drain S or into the recirculation branch 36, to be then delivered again to the nozzles 31.

In fact, when the water is contaminated by filaments, the valve 39 will direct it towards the drain S, otherwise it will be reused for a filter cleaning cycle.

The following will describe the operation of the above-considered washing/drying machine, with particular reference to the device 5 for cleaning the filter 25. As regards the washing and drying functions, the following description will only tackle those aspects that may be useful for understanding the invention; for further details, therefore, reference should be made to the operation of the washing/drying machines known in the art.

When, during an operating cycle of the washing/drying machine, the filter 25 becomes clogged with filaments released by the laundry being treated, the cleaning device 5 will be activated to spray water from the nozzles 31 against the filtering walls 27 of the filter 25, so as to remove the filaments deposited thereon.

In particular, as indicated by the arrows in FIGS. 5 and 6, the nozzles 31 spray water into the filter 25, preferably directing the jet in a manner substantially tangential to the filtering walls 27 or anyway at a small angle of incidence relative to the surface of the latter, which in this case is cylindrical; in this description and in the appended claims, the angle of incidence refers to the angle defined by the direction of a water jet and by the profile of the filtering wall 27 against which the jet is directed.

This way of spraying water promotes the removal of the filaments deposited on the filtering walls 27, while at the same time avoiding the application of excessive hydrodynamic pressure onto them, which might otherwise damage them, as it would happen if the jet were directed perpendicularly to the filtering surface.

It should be noted, in fact, that when the filtering surfaces 27 are thin (e.g. made out of braided wires or synthetic fabrics) and/or have a small and thick mesh, the action of a jet directed perpendicularly against them might deform them because of its hydrodynamic pressure, thereby jeopardizing their efficiency and reliability.

It should also be highlighted that, in accordance with the present invention, the water jets sprayed by the nozzles are directed inside the filter 25, i.e. the part thereof whereon filaments get deposited: this ensures a more effective removal action, because the water jets will directly act upon the filaments.

In this respect, it must be pointed out that the Applicant has verified the effectiveness of this solution with water jets directed inside the filter, compared to the solution wherein the water jets are external, i.e. water is sprayed onto the side of the filtering walls opposite to that on which filaments get deposited.

Once removed, the filaments are evacuated along with the cleaning water through the drain 37 of the washing chamber 10.

Note that, depending on the operating steps of the washing/drying machine 1, the cleaning water may be water coming from the household mains, supplied through the tap 35, or recirculated water coming from the branch 36 that collects the condensed water created by the drying air in the intake duct 21.

The management of the filter cleaning water, i.e. mains water or recirculated water, essentially depends on the mode in which the filter is to be cleaned.

For example, the cleaning device 5 may be made to operate continuously during the drying step or, in order to optimize water consumption, it may operate in an intermittent and/or impulsive manner, in which case the device 5 will only be activated during particular time intervals in the course of the drying step, or, alternatively, in the course of one or more substeps specifically dedicated to the cleaning of the filter 25.

Preferably, the cleaning device 5 is turned on at the end of a drying cycle, or anyway before a new wash cycle begins; in such circumstances, with the machine empty or with a small load in the basket 11, water will be supplied to the nozzles 31 from the mains when the intake tap 35 is opened.

According to a preferred mode of controlling the device 5, this will be activated when the relative humidity in the chamber 10 falls below a preset threshold. It will be only from then onwards, in fact, that filaments, fibres, lint or bobbles will be released from the laundry in a significant amount. For example, one may conceive a pulsed activation of the device 5 when a residual humidity of 10% is reached in the chamber 10, with a duty cycle depending on the pressure and/or flow of the water supplied to the nozzles 31. The residual humidity in the tub can be sensed in a known manner, e.g. by applying the teachings of patent application GB2154721A.

The filter will then be washed with mains water, which will then be evacuated from the tub bottom through the drain S; in this case, the diverting valve 39 will send the nozzle washing water directly towards the drain.

If on the contrary no filaments are found in the water, the latter can be reused for washing the filter 25; this working cycle may be carried out either in a programmed manner, i.e. with a certain timing or after a certain number of drying cycles of the machine 1, or in a controlled manner, through the use of suitable sensors.

For example, let us consider the case wherein one wants to detect any leakage in the circuit 20 of the drying air; this detection can be made either by means of suitable pressure sensors or by reading the values of the electric power absorbed by the electric motor that drives the fan 23.

When the absorbed power reaches certain preset levels, this means that the filter is clogged and requires the removal of the filaments deposited thereon.

As an alternative, the condition of the filter 25 can be controlled by means of optical sensors: the presence of filaments deposited on the filter will prevent the passage of luminous signals, and this condition can be detected by means of optical sensors, so that a cleaning cycle can then be started as explained above.

Of course, the invention may be subject to other variations with respect to the description provided so far.

In fact, although the example shown in the drawings is structurally and functionally simple, thus being preferable because it is economically advantageous, the use of different solutions should not be excluded as concerns the nozzles and their supply system.

For example, the nozzles 31 of the crown 31*a* may be fed separately (e.g. divided into sectors of the crown) and spray water only onto predefined areas of the filter, should they become clogged.

All of these variants will still fall within the scope of the following claims.

The invention claimed is:

1. A washing/drying machine comprising:

a washing/drying chamber;

a basket housed in said chamber for loading laundry to be treated;

an air circuit comprising an intake channel, a delivery channel and a fan arranged between the intake channel and the delivery channel, for circulating air taken in from the chamber, the intake channel having a cylindrical geometry forming an intake port in communication with an aperture formed in a back wall of the chamber;

a filter comprising:

a cage-like structure having a cylindrical geometry complimentary in shape to the intake port in the intake channel and configured to be inserted in the intake port;

a filtering wall arranged about the cylindrical geometry of the cage-like structure; and a crown having a cylindrical structure comprising a plurality of water nozzles distributed about a periphery of the crown, the crown configured to connect to the cage-like structure for jetting water onto a side of the filter facing toward the chamber where filaments get depoisted during circulation of air in the air circuit;

the cage-like structure and the crown configured to be secured to the cylindrical geometry forming the intake port in the intake channel.

2. The washing/drying machine according to claim 1, wherein water is jetted against the filtering wall tangential thereto.

3. The washing/drying machine according to claim 2, further comprising a hydraulic circuit for supplying water to the plurality of water nozzles.

4. The washing/drying machine according to claim 3, wherein the hydraulic circuit for recirculating water coming from the chamber and/or from the air circuit, to be supplied to the nozzles.

5. The washing/drying machine according to claim 1, wherein the water nozzles are defined by a plurality of protrusions extending from and positioned around the periphery of the crown.

6. The washing/drying machine according to claim 1, wherein the crown comprises one or more appendices extending from a base of the crown.

7. The washing/drying machine according to claim 6, wherein the cage-like structure comprises at least one slot for engaging the one or more appendices of the crown.

* * * * *